US005386901A

United States Patent [19]

Ibarrola et al.

[11] Patent Number: 5,386,901

[45] Date of Patent: Feb. 7, 1995

[54] COIN SELECTOR

[75] Inventors: Jesüs E. Ibarrola; Josë L. P. Insausti, both of Pamplona, Spain

[73] Assignee: Azkoyen Industrial S.A., Peralta, Spain

[21] Appl. No.: 75,242

[22] Filed: Jun. 11, 1993

[30] Foreign Application Priority Data

Jun. 12, 1992 [ES] Spain ..... 9201228

[51] Int. Cl.[6] ..... G07D 5/08

[52] U.S. Cl. ..... 194/244; 194/308; 194/317

[58] Field of Search ..... 194/242, 244, 317, 318, 194/319, 308, 331, 337; 453/32

[56] References Cited

U.S. PATENT DOCUMENTS

| | | | |
|---|---|---|---|
| Re. 32,799 | 12/1988 | Abe | 453/32 |
| 884,441 | 4/1908 | Weser | 194/308 |
| 1,625,979 | 4/1927 | Brinkerhoff . | |
| 3,211,267 | 10/1965 | Bayha | 194/317 X |
| 3,415,256 | 12/1968 | Meloni . | |
| 3,712,441 | 1/1973 | Taylor . | |
| 3,837,454 | 9/1974 | Joeck | 194/318 |
| 3,878,711 | 4/1975 | Randolph . | |
| 4,105,105 | 8/1978 | Braum . | |
| 4,263,924 | 4/1981 | Johnson . | |
| 4,503,961 | 3/1985 | Chittleborough . | |
| 4,650,057 | 3/1987 | Koester . | |
| 4,690,263 | 9/1987 | Yokomori . | |
| 4,893,706 | 1/1990 | Ibarrola . | |
| 5,063,518 | 11/1991 | Chitty et al. . | |
| 5,067,604 | 11/1991 | Metcalf . | |
| 5,085,309 | 2/1992 | Adamson et al. . | |

FOREIGN PATENT DOCUMENTS

| | | |
|---|---|---|
| 0000010 | 12/1978 | European Pat. Off. . |
| 0184393 | 6/1986 | European Pat. Off. . |
| 0246993 | 11/1987 | European Pat. Off. . |
| 0323396 | 7/1989 | European Pat. Off. . |
| 0360506 | 3/1990 | European Pat. Off. . |
| 747958 | 6/1933 | France . |
| 2293749 | 7/1976 | France . |
| 603120 | 9/1934 | Germany . |
| 2825094 | 12/1979 | Germany . |
| 3009466 | 9/1981 | Germany . |
| 3512579 | 10/1986 | Germany . |
| 549841 | 12/1985 | Spain . |
| 555181 | 5/1986 | Spain . |
| 11006 | 8/1892 | United Kingdom . |
| 727581 | 4/1955 | United Kingdom . |
| 1066389 | 4/1967 | United Kingdom . |
| 1486519 | 9/1977 | United Kingdom . |
| 2022897 | 12/1979 | United Kingdom . |
| 2047936 | 12/1980 | United Kingdom . |
| 2070307 | 9/1981 | United Kingdom . |
| 2105893 | 3/1983 | United Kingdom . |
| 2135094 | 8/1984 | United Kingdom . |
| 8300400 | 2/1983 | WIPO . |

*Primary Examiner*—F. J. Bartuska

*Attorney, Agent, or Firm*—Rothwell, Figg, Ernst & Kurz

[57] ABSTRACT

Coin selector, which defines a route or path for the coins, along which are fitted optical and electromagnetic sensors and at least one rocker arm located towards the entrance to that route or path which is responsible for directing the coins towards the correct path. The selector also includes a mobile permanent magnet and a fixed magnetic relay close to that magnet, the magnet being fitted to the rocker arm and located towards the entrance to the path for the coins. The displacement of the rocker arm pulls the magnet, varying the action of the magnet's magnetic field on the relay. The relay is connected to a power supply circuit for the sensor, which is activated when a coin is introduced.

2 Claims, 1 Drawing Sheet

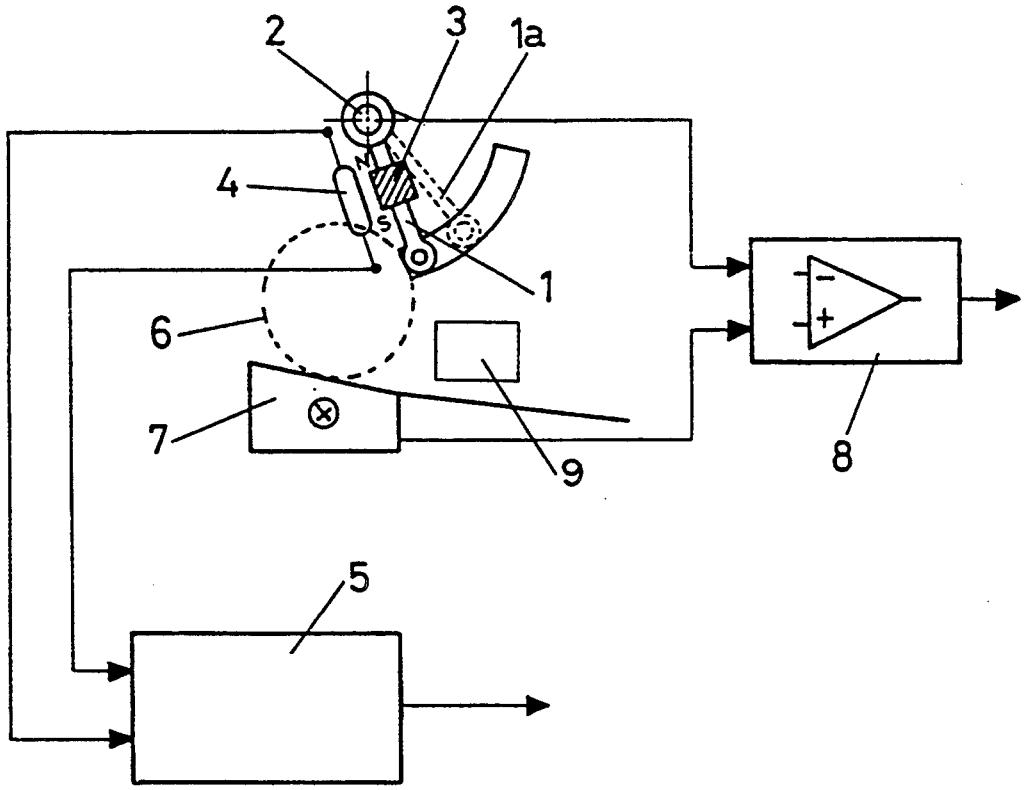
2
3
1a
4
N
S
1
6
7
9
8
5

COIN SELECTOR

FIELD OF THE INVENTION

This invention concerns a coin selector, especially applicable to machines that are put into operation by means of introducing one or more coins.

More specifically, the selector of the invention is especially conceived for being fitted in machines or apparatus in which electricity consumption is low and therefore, the selector's consumption must be minimal.

DESCRIPTION OF RELEVANT ART

Coin selectors have the basic aim of detecting whether the coins that are introduced therein are valid or not, rejecting non-valid coins and accepting valid ones, once their value is known.

The selectors carry out their functions by means of detectors, generally of the optical and/or electromagnetic type, whose functioning requires the consumption of a certain quantity of energy.

In some apparatus provided with coin selectors, it is necessary to reduce energy consumption as much as possible. For this reason, selectors are already known whose detection systems for the validation of coins are disconnected from the power supply source and have at their entrance a switch consisting of a detector for the presence of coins, which connects the functioning circuits of the selector when the detector for the presence of coins detects the entrance of a discoid piece or coin.

In the selectors known of the type indicated, the detector for the presence of coins consists of an optical detector, for example based on a photodiode emitter and a photodiode receiver, which detector requires its constant connection to an electrical power supply source. Although the electricity consumption of this type of detector is very low, it is nevertheless not sufficiently small to allow it to be used in systems whose functioning is based on constant supply from electrical batteries long periods of time.

SUMMARY OF THE INVENTION

The present invention concerns a coin selector of the indicated type, which includes means, for detecting the validity and value of the coins and also an entrance switch, consisting of a detector for the presence of coins, and has as its object the development of a detector for the presence of coins with virtually zero electricity consumption, in such a way that the selector's total consumption is restricted to its functioning periods, starting from the moment a coin is introduced.

In accordance with this invention, the detector for the presence of coins consists of a mobile permanent magnet and a fixed magnetic relay, located close to the magnet. The magnet is fitted to a lever located in the selector in the path of the coins, close to the entrance, this lever being freely displaceable by the passage of each coin introduced and serving to pull the magnet as it is displaced.

Throughout this disclosure, it must be understood that the term "magnetic relay" refers to any system of electrical switch that can be activated magnetically, such as a reed relay, a Hall effect detector, etc.

The displacement of the lever and magnet fitted thereto is carried out between a rest position and one of activation. Between these two positions, the relative position between the magnet and magnetic relay varies and, with it, the action of the magnetos magnetic field on the relay.

The magnetic relay is permanently fed from a certain supply source and is connected to a feed connection circuit for the selector, which it activates by the effect of fluctuations in the magnetic field caused by varying thee relative position between the magnet and relay.

In the detector for the presence of coins as described, the only component connected to a supply source is the relay. By means of using a magnetic relay, the consumption of the detector is reduced to the minimum, so this equipment can thereby be used in apparatus or systems whose power supply is by means of batteries.

In coin selectors, it is known that rocker arms can be fitted in the path or route of the coins, the arms being responsible for directing the coins towards the proper path. These rocker arms are fitted at least in the entrance to the selector and in certain cases also at the exit from the selector. In accordance with this invention, the lever on which the permanent magnet is fitted can consist of the rocker arm located towards the entrance to the path of the coins.

Moreover, the rocker arm or lever on which the magnet is fitted can be of a metallic nature, in order to constitute, along with a second metal piece defining the rolling route of the coins, two electrical contacts via which a detection circuit is closed when a coin having a metallic nature is interposed between them, the separation between the two pieces being less than the diameter of the smallest coin that can be accepted by the selector. With this arrangement, the detection device for the presence of coins could also serve for detecting whether the coins introduced have rims with an electrically insulating or conducting nature.

With this last design, it is possible to detect certain falsifications based on the use of coins of a value and size less than that of the valid coins, and which are complemented by means of a peripheral ring of plastic material.

The stated characteristics and advantages can be more easily understood with the following description, made with reference to the attached diagram.

BRIEF DESCRIPTION OF THE DRAWING

The Figure is a schematic diagram of a detector for the presence designed in accordance with the invention, and applicable to a coin selector.

DESCRIPTION OF THE DRAWING

In the attached diagram, referenced with number 1 is a lever arranged inside the selector, in the path or route of the coins and which can freely swing around the assembly linkage shaft 2 between two extreme positions, one of rest, represented by means of solid lines in the diagram, and the other of activation, represented in the diagram by means of broken lines and referenced with number 1*a*.

Fitted to the lever 1 is a permanent magnet 3 and close to it is a reed relay 4, which is connected to a connection circuit 5 for the selector.

The lever 1, as has been indicated, is arranged in the path or route of the coins in such a way that, each time a coin 6 is introduced into the selector, it displaces the lever 1 from the rest position to the position of activation 1*a*, the lever resuming its rest position once the coin has passed.

The displacements of the lever 1 pull the permanent magnet 3, varying the relative position between that magnet and the relay 4 and, with it, the action of the magnetic field of the magnet 3 on the relay 4.

In these changes of situation, the circuit 5 is opened or closed, which will cause the connection of the different circuits and components of the coin selector. Specifically, closure of the circuit 5 occurs upon the presence of a coin in the selector, as described above, which results in circuit 5 supplying power to the sensor indicated schematically at 9, which sensor may be an optical or electromagnetic sensor, or a combination of same.

The arrangement described, with virtually zero consumption, succeeds in providing a switch for the presence of coins, consisting of the permanent magnet 3 and the relay 4, by means of which the electrical connection of the selector will be carried out each time a coin is introduced, keeping it disconnected for the rest of the time, without any electricity consumption being produced.

The lever 1 can consist of the rocker arm included in certain coin selectors for guiding or directing the introduced coins towards the proper path.

In any case, the lever or rocker arm 1 can be made from an electrically conducting material, for example of a metallic nature, for constituting, along with a second metal piece defining the rolling route of the coins 6, two electrical contacts via which a detection circuit 8 is closed when a coin 6 whose rim has a metallic nature is interposed between the lever 1 and the piece 2. The distance between the piece 7 and the lever 1 will be less than the diameter of the smallest coin that can be accepted by the selector.

With this arrangement, each time a coin 6 is introduced, if its rim has a metallic nature it will close the circuit 8. In the event of the rim of the coin 6 being of an insulating material, closure of the circuit 8 will not take place.

This arrangement makes it possible to know whether the introduced coin 6 has a metal rim or not, thereby detecting possible frauds based on the use of coins with smaller value and size than those that can be accepted by the selector and provided with a peripheral hoop of a plastic material which, without altering the metallic characteristics of the coin, allows it to achieve the size of coins of maximum value.

The selector of the invention can include solely the elements making up the detector for the presence of coins, consisting of the permanent magnet 3 and the relay 4, along with the circuit 5 that detects changes in the state of that relay, using a lever 1 of plastic material, or also using a lever 1 having a metallic nature so that, along with the metal piece 7 and the circuit 8, a detector is obtained that allows the electrically insulating or conducting nature of the rim of the coins introduced to be known.

We claim:

1. A coin selector apparatus comprising:

a path defined by the selector along which a coin travels when introduced into the selector, the path having at least one of an optical sensor and an electromagnetic sensor for detecting the validity and value of the coin;

a rocker arm disposed adjacent the entrance to the path for directing the coin to the path, the rocker arm including a permanent magnet, the rocker arm and permanent magnet being movable from a position of rest to a position of activation upon the passage of a coin;

a fixed magnetic relay disposed near the permanent magnet and being connected to a connection circuit for a power supply to the at least one sensor;

wherein the relative position between the permanent magnet and the magnetic relay varies as the rocker arm moves between said two positions so as to vary the action of the magnetic field of the permanent magnet on the magnetic relay, and the connection circuit is activated by the relay as a consequence of the variations in said magnetic field caused by the relative movement between the permanent magnet and the magnetic relay due to the presence of a coin in the selector.

2. A coin selector apparatus according to claim 1, wherein the rocker arm has an electrically conducting nature in order to constitute, along with a second metal piece defining the path of the coins, two electrical contacts via which a detection circuit is closed when a coin with a rim having a metallic nature is interposed between the two contacts, the distance between the rocker arm and the second metal piece being less than diameter of the smallest coin that can be accepted by the selector.

* * * * *

UNITED STATES PATENT AND TRADEMARK OFFICE

CERTIFICATE OF CORRECTION

PATENT NO. : 5,386,901

DATED : February 7, 1995

INVENTOR(S) : J. Ibarrola et al.

It is certified that error appears in the above-identified patent and that said Letters Patent is hereby corrected as shown below:

On the cover, in section [75] Inventors, "Jesüs" should be --Jesús-- and "Josë" should be --José--.

Col. 2, line 1, "magnetos" should be --magnet's--.

Col. 2, line 7, "thee" should be --the--.

Col. 2, line 46, after "presence" insert --of coins,--.

Signed and Sealed this

Twentieth Day of June, 1995

*Attest:*

*Attesting Officer*

BRUCE LEHMAN

*Commissioner of Patents and Trademarks*